US007241492B2

(12) United States Patent
Kohara et al.

(10) Patent No.: US 7,241,492 B2
(45) Date of Patent: Jul. 10, 2007

(54) MULTILAYERED FILM HAVING EXCELLENT WEAR RESISTANCE, HEAT RESISTANCE AND ADHESION TO SUBSTRATE AND METHOD FOR PRODUCING THE SAME

(75) Inventors: Toshimitsu Kohara, Takasago (JP); Hiroshi Tamagaki, Takasago (JP); Kenji Yamamoto, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 129 days.

(21) Appl. No.: 10/933,374

(22) Filed: Sep. 3, 2004

(65) Prior Publication Data

US 2005/0058850 A1 Mar. 17, 2005

(30) Foreign Application Priority Data

Sep. 16, 2003 (JP) ..... 2003-323582

(51) Int. Cl.
*B32B 9/00* (2006.01)

(52) U.S. Cl. ..... 428/336; 427/402; 427/419.1; 427/419.2; 427/419.3; 427/419.7; 427/532; 428/472; 428/698; 428/701; 428/702; 428/704

(58) Field of Classification Search ..... 428/701, 428/702, 469, 472, 446, 336, 216, 698, 704; 427/532, 402, 419.1, 419.2, 419.3, 419.7
See application file for complete search history.

(56) References Cited

U.S. PATENT DOCUMENTS 5,693,417 A * 12/1997 Goedicke et al. ..... 428/216
5,879,823 A * 3/1999 Prizzi et al. ..... 428/702
6,086,953 A * 7/2000 Raghavan et al. ..... 427/419.2
6,156,383 A * 12/2000 Ishii et al. ..... 427/419.2

(Continued)

FOREIGN PATENT DOCUMENTS

JP 2002-53946 2/2002

(Continued)

OTHER PUBLICATIONS

U.S. Appl. No. 10/554,601, filed Oct. 27, 2005, Tamagaki et al.

(Continued)

*Primary Examiner*—Archene Turner
(74) *Attorney, Agent, or Firm*—Oblon, Spivak, McClelland, Maier & Neustadt, P.C.

(57) ABSTRACT

A multilayered film of the present invention includes a hard film provided on a substrate and including a compound of essential metal components, Al and Ti, with C, N, B, or O, and an intermediate layer formed between the substrate and the hard film, the intermediate layer including at least one selected from the group consisting of a metal, an alloy, and a compound of the metal or the alloy, and having an oxidation temperature lower than that of the hard film. The multilayered film further includes an oxide-containing layer formed by oxidizing the hard film, and an alumina film formed on the surface of the oxide-containing layer. The multilayered film of the present invention has excellent adhesion to the substrate, excellent heat resistance, and excellent oxidation resistance when being exposed to a substrate temperature of 700° C. or more and an oxidizing atmosphere.

15 Claims, 7 Drawing Sheets

U.S. PATENT DOCUMENTS

| | | | | |
|---|---|---|---|---|
| 6,187,421 | B1 | 2/2001 | Moriguchi et al. | |
| 6,210,726 | B1 * | 4/2001 | Schiller et al. | 428/701 |
| 6,254,984 | B1 * | 7/2001 | Iyori | 428/336 |
| 2005/0058850 | A1 | 3/2005 | Kohara et al. | |
| 2005/0276990 | A1 * | 12/2005 | Kohara et al. | 428/469 |

FOREIGN PATENT DOCUMENTS

| | | |
|---|---|---|
| KR | 2000-0069901 | 11/2000 |

OTHER PUBLICATIONS

U.S. Appl. No. 10/551,993, filed Oct. 4, 2005, Tamagaki et al.

U.S. Appl. No. 11/174,551, filed Jul. 6, 2005, Kohara et al.

Tsutomu Ikeda, et al., "Phase Formation and Characterization of Hard Coatings in the Ti-Al-N System Prepared by the Cathodic Arc Ion Plating Method", Metallurgical and Protective Layers, Thin Solid Films, 195, 1991, pp. 99-110.

* cited by examiner

MULTILAYERED FILM HAVING EXCELLENT WEAR RESISTANCE, HEAT RESISTANCE AND ADHESION TO SUBSTRATE AND METHOD FOR PRODUCING THE SAME

BACKGROUND OF THE INVENTION

1. Field of the Invention

The present invention relates to a multilayered film coated on a wear-resistant member such as a cutting tool, a sliding member, or a mold. Particularly, the present invention relates to a multilayered film having excellent adhesion to a substrate of the cutting tool or sliding member, and excellent wear resistance and heat resistance, and a method for producing the multilayered film. The multilayered film of the present invention can be used for the above-described various applications. However, application to a cutting tool will be mainly described below as a representative example.

2. Description of the Related Art

In general, cutting tools and sliding members required to have excellent wear resistance and low friction comprise a substrate comprising high-speed steel or a cemented carbide, and a hard film comprising titanium nitride or titanium aluminum nitride and formed on the surface of the substrate by a physical vapor deposition method (referred to as a "PVD method" hereinafter) or a chemical vapor deposition (referred to as a "CVD method" hereinafter).

Particularly, the hard film used for the cutting tool is required to have wear resistance and heat resistance (oxidation resistance at high temperatures). In recent years, therefore, titanium aluminum nitride (TiAlN) having both the properties has been frequently used as a coating material for a cemented carbide tool in which the cutting edge reaches a high temperature during cutting. The reason why TiAlN exhibits the excellent characteristics is that the heat resistance is improved by the action of aluminum contained in a film, and stable wear resistance and heat resistance can be maintained up to a high temperature of about 800° C.

In some cases, the cutting edge of a cutting tool reaches a high temperature of 1000° C. or more during cutting. Under such a condition, sufficient heat resistance cannot be secured only by the TiAlN film, and thus an alumina layer is further formed on the TiAlN film to secure heat resistance, as disclosed in U.S. patent application Ser. No. 5,879,823.

Alumina has various crystal structures depending upon temperatures, but all the crystal structures are thermally metastable. However, when the temperature of the cutting edge of the cutting tool significantly changes over a wide range from room temperature to 1000° C. or more during cutting, the crystal structure of alumina changes to disadvantageously cause cracking or delamination in the film. However, in alumina having a α-crystal structure formed by a CVD method in which the substrate temperature is increased to 1000° C. or more, the thermally stable structure is maintained after the formation regardless of temperature. Therefore, in order to impart heat resistance to the cutting tool, it is effective to coat the cutting tool with an alumina film having a α-crystal structure.

However, as described above, in order to form alumina having a α-crystal structure the substrate must be heated to 1000° C. or more, and thus only limited substrates can be used. This is because a certain type of substrate is possibly softened to lose suitability for a substrate for wear-resistant members when being exposed to a high temperature of 1000° C. or more. Also, a high-temperature substrate such as a cemented carbide disadvantageously causes deformation when being exposed to such a high temperature. The hard film such as the TiAlN film formed as a film exhibiting wear resistance on the substrate generally has a maximum practical temperature of about 800° C., and thus the film possibly changes in properties to degrade the wear resistance when being exposed to a high temperature of 1000° C. or more.

As a technique for solving the above problem, Japanese Unexamined Patent Application Publication No. 2002-53946 discloses a method in which an underlying layer comprising a corundum structure (α-crystal structure) oxide film having a lattice constant of 4.779 Å to 5.000 Å and a thickness of at least 0.005 μm is formed, and an alumina film having a α-crystal structure is formed on the underlying layer. The component of the oxide film is preferably $Cr_2O_3$, $(Fe, Cr)_2O_3$, or $(Al, Cr)_2O_3$. When the component of the oxide film is $(Fe, Cr)_2O_3$, $(Fe_x, Cr_{(1-x)})_2O_3$ (wherein x is $0 \leqq x \leqq 0.54$) is preferably used. When the component of the oxide film is $(Al, Cr)_2O_3$, $(Al_y, Cr_{(1-y)})_2O_3$ (wherein y is $0 \leqq y \leqq 0.90$) is preferably used.

It is also disclosed that crystalline α-alumina can be formed at a low substrate temperature by a method comprising forming a hard film comprising a compound nitride film composed of Al and at least one element selected from the group consisting of Ti, Cr, and V, forming an intermediate layer comprising a film of $(Al_z, Cr_{(1-z)})N$ (wherein z is $0 \leqq z \leqq 0.90$), oxidizing the intermediate layer to form a corundum structure (α-crystal structure) oxide film, and then forming a α-alumina film on the oxide film.

The above publication also discloses an example of this method in which a CrN film is formed on a substrate and then oxidized to form corundum structure $Cr_2O_3$, and then alumina mainly having a α-structure is formed on $Cr_2O_3$. However, as a result of research of these techniques, the inventors found that the techniques require heating the substrate to about 700° C. to 750° C. in an oxidizing atmosphere, and the CrN film easily delaminates from the substrate after this heating step. Therefore, further improvement is required for increasing adhesion between the substrate and the multilayered film.

The inventors already have proposed a film having excellent heat resistance and wear resistance, the film being formed by forming a TiAlN film as a hard film on the surface of a cutting tool, and further forming an alumina film mainly having a α-crystal structure on the TiAlN film (Japanese Patent Application No. 2002-231954). Specifically, the inventors have proposed that the hard film (TiAlN film) is formed on a substrate, the surface of the hard film is oxidized to form an oxide-containing layer on the surface of the hard film, and then an alumina film mainly having a α-crystal structure on the oxide-containing layer.

This method can improve productivity in comparison with the method disclosed in Japanese Unexamined Patent Application Publication No. 2002-53946 in which the TiAlN film is formed, the CrN film is formed and then oxidized to form corundum structure $Cr_2O_3$, and then the alumina film mainly having a α-crystal structure is formed. It is also possible to avoid cutting performance from being decreased due to Cr-containing films such as a $Cr_2O_3$ layer and a $(CrN+Cr_2O_3)$ compound layer formed as the intermediate film.

However, when the alumina mainly having a α-structure is formed on the oxide-containing layer, formed by oxidizing the surface of the hard film (TiAlN film), the temperature of the substrate must be increased to about 700° C. to 750° C. in an oxidizing atmosphere. Like in the method disclosed in Japanese Unexamined Patent Application Publication No. 2002-53946, the hard film (TiAlN film) possibly delaminates from the substrate. Therefore, further improvement is required for increasing adhesion between the substrate and the multilayered film.

SUMMARY OF THE INVENTION

Accordingly, the present invention has been achieved in consideration of the problem that since a substrate must is to 700° C. or more in an oxidizing atmosphere, for example, when an alumina film is formed on a hard film, the hard film often delaminates from the substrate, and particularly when the substrate is a superhard substrate, the hard film easily delaminates from the substrate. An object of the present invention is to provide a method for producing a multilayered film having excellent adhesion to a substrate, excellent wear resistance, and excellent heat resistance.

In order to solvent the problem, a multilayered film provided on a substrate and having excellent heat resistance, excellent wear resistance, and excellent adhesion to the substrate according to the present invention comprises a hard film comprising a compound of metal components essentially including Al and Ti with C, N, B, or O, an intermediate layer provided between the substrate and the hard film and comprising at least one layer which is oxidized at a temperature lower than the oxidation temperature of the hard film, preferably lower than 700° C., and which is selected from the group consisting of (a) a metal layer, (b) an alloy layer, and (c) a compound layer of the metal or alloy with C, N, B, or O, an oxide-containing layer formed by oxidizing the hard film, and an alumina film formed on the oxide-containing layer.

As the intermediate layer, a Ti metal layer or a compound layer of Ti with C, N, B, or O is preferably formed.

As the hard film, a compound of the essential metal components Al and Ti, with C, N, B, or O is preferred because of excellent wear resistance. The hard film may further contain, as a third element, at least one element selected from the group consisting of the elements in Group IVa (excluding Ti), Group Va, and Group VIa, and Si.

In the multilayered film of the present invention, preferably, the outermost surface of the oxide-containing layer substantially comprises alumina, and the alumina film formed on the oxide-containing layer mainly has a $\alpha$-crystal structure because excellent wear resistance and excellent oxidation resistance are exhibited.

The present invention also defines a method for producing the above-described multilayered film. The method for producing the multilayered film comprises the following steps:

(I) forming the intermediate layer on the substrate;

(II) forming the hard film on the intermediate layer;

(III) oxidizing the surface of the hard film to form the oxide-containing layer; and (IV) forming the alumina film on the oxide-containing layer.

When the step of oxidizing the surface of the hard film to form the oxide-containing layer and/or the step of forming the alumina film on the oxide-containing layer is performed at a substrate temperature of 700° C. or more in an oxidizing atmosphere, the effect of the present invention is effectively exhibited.

Preferably, the surface oxidation of the hard film and the formation of the alumina film are successively performed in a same apparatus, and the intermediate layer and the hard film are successively formed in a same apparatus. This is because little contaminations adhere to the top surfaces of the oxide-containing layer and the intermediate layer to secure adhesion between the oxide-containing layer and the alumina film and between the intermediate layer and the hard film, and productivity can be improved. More preferably, the formation of the intermediate layer and the hard film, the surface oxidation of the hard film, and the formation of the alumina film are successively performed in a same apparatus.

According to the present invention, when an alumina film is formed on a hard film formed on a substrate of a cutting tool or the like, and delamination of the hard film from the substrate, which easily occurs in surface treatment of the hard film, can be suppressed. Consequently, a cutting tool or a sliding member coated with a multilayered film having excellent adhesion to a substrate, excellent wear resistance, and excellent heat resistance can be provided.

DESCRIPTION OF THE PREFERRED EMBODIMENTS

The inventors conducted intensive research for producing a multilayered film capable of maintaining excellent adhesion to a substrate even when a hard film comprising a compound of metal components essentially including Al and Ti with C, N. B, or O is formed on the substrate and exposed to a substrate temperature of 700° C. or more in an oxidizing atmosphere, and for establishing a method for producing the multilayered film. As a result, it was found that an intermediate layer which undergoes oxidation reaction at a temperature lower than that of the hard film, for example, lower than 700° C., is preferably provided between the substrate and the hard film, and the intermediate layer comprises at least one layer selected from the group consisting of (a) a metal layer, (b) an alloy layer, and (c) a compound layer comprising the metal or alloy and C, N, B, or O. The present invention has been achieved on the basis of this finding. The reason for utilizing the above-described film structure will be described in detail below.

Figure 9:
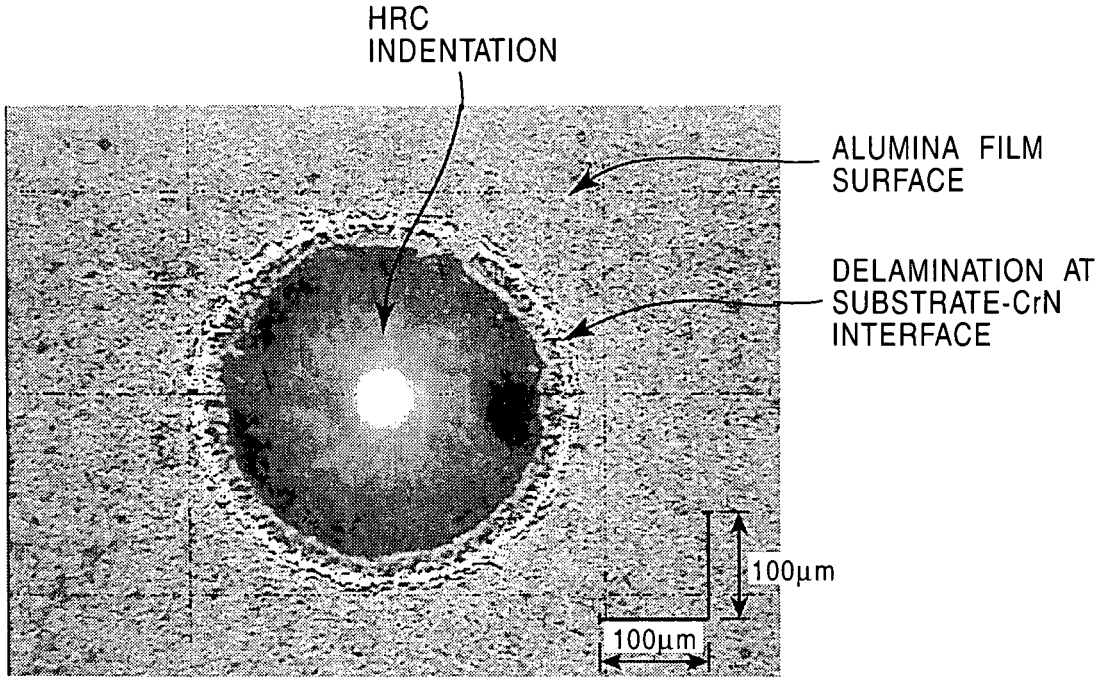
FIG. 9 is a photograph (magnification of ×400) of the top of a HRC indentation in Comparative Example 3.
Figure 10:
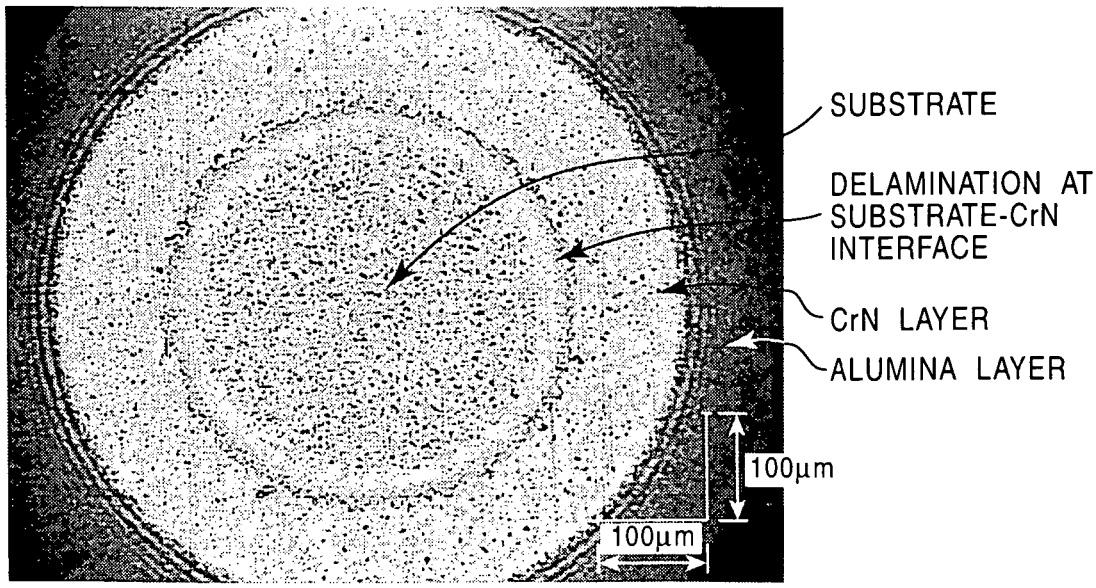
FIG. 10 is a photograph (magnification of ×400) of the top of a Calotest indentation in Comparative Example 3.

In "Thin Solid Films" (195, 1991, pp. 99-110), Ikeda et al. indicate the high-temperature oxidation behavior of a TiAlN film in which an alumina thin film is formed on the outermost surface of the TiAlN film when the TiAlN film is oxidized in an oxygen-containing atmosphere at a high temperature. Also, FIG. 9 of this document shows a graph showing increases in mass of a TiN film and a TiAlN film in heating in an oxygen-containing atmosphere. This graph indicates that the oxidation start temperature of TiN is 550° C., while the oxidation start temperature of TiAlN is 750° C. or more.

On the basis of these results, it can be supposed that for example, when a TIAlN hard film containing Al and Ti is exposed to a temperature of 700° C. to 750° C., an alumina thin layer is formed on the surface, and thus oxidation does not further proceed. However, many substrates easily react with oxygen in the above temperature region to form brittle layers on the surfaces of the substrates due to reaction with oxygen.

Therefore, in the above-described techniques, adhesion between the substrate and the multilayered film is possibly decreased due to the fact that when the substrate with the surface coated with the hard film is exposed to a temperature of 700° C. to 750° C. for forming, for example, an alumina film, the hard film itself little reacts with oxygen as described above, but oxygen enters in the hard film through pinholes presenting therein and diffuses at the interface between the hard film and the substrate to form the brittle layer on the surface of the substrate.

Therefore, the inventors found that in order to absorb oxygen diffusing into the hard film through the pinholes of the hard film to form an oxide in the intermediate layer for preventing oxygen from reaching the substrate, the intermediate layer is preferably formed between the substrate and the hard film, the intermediate layer comprising at least one layer which is more easily oxidized than the hard film (oxidation proceeds even at a temperature lower than 700° C.) and which is selected from the group consisting of (a) a metal layer, (b) an alloy layer, and (c) a compound layer comprising the metal or alloy and C, N, B, or O.

Examples of the metal layer used as the intermediate layer include a Ti metal layer, a Zr metal layer, and a V metal layer. However, a Ti metal layer is preferred because it is easily oxidized to form a Ti oxide. Examples of the alloy layer include a TiZr layer, a TiV layer, and a ZrV layer. Among these layers, a TiZr layer is preferred.

Examples of the compound layer comprising the metal or alloy and C, N, B, or O include a ZrN layer, a ZrCN layer, a VC layer, a VN layer, a TiZrN layer, and a TiCrN layer. However, compound layers of Ti with C, N, B, or O are preferred because the layers are easily oxidized and form high-strength films which can be also used as hard films.

Specifically, a TiN layer, a TiCN layer, a TiC layer, a TiBN layer, a TiON layer, and a TiBCN layer can be used, and at least one layer selected from the group consisting of a TiN layer, a TiCN layer, and a TiC layer is preferably used. For example, when the intermediate layer has a composition TiN near the substrate and a composition TICN near the hard film, and has a component gradient in the thickness direction in which the C content increases in the direction nearer to the hard film, the effect of further improving adhesion and wear resistance can be expected.

In the document of Ikeda et al., it is described that the oxidation start temperature of the TiAlN film decreases as the Al content in TiAlN decreases. Therefore, even when a compound having a lower Al content than that of the compound of the essential metal components Al and Ti with C, N, B, or O and used as the hard film of the present invention is used for the intermediate layer, a certain degree of effect can be expected.

In order to effectively inhibit oxygen diffusion to the substrate, the thickness (a total thickness when the intermediate layer includes a plurality of layers) of the intermediate layer is preferably 0.1 μm or more, and more preferably 0.3 μm or more. However, when the thickness of the hard film is excessively large, the intermediate layer is easily cracked during cutting to fail to achieve a long lifetime. Therefore, the thickness of the hard film is preferably 20 μm or less, and more preferably 10 μm or less.

Although the method for forming the intermediate layer is not particularly limited, a PVD method is preferred for efficiently forming the intermediate layer, and an AIP (arc ion plating) method and a reactive sputtering method are more preferred as the PVD method. Also, from the viewpoint of improvement in productivity, the PVD method for forming the intermediate layer is preferred because the intermediate layer, the hard film, and the alumina film mainly having a α-structure can be formed in the same apparatus, as described below.

<Substrate>

Examples of the substrate include a cemented carbide, a cermet, ceramic, and high-speed tool steel. In the use of a cemented carbide among these materials, a tungsten oxide is easily formed on the surface when the alloy is exposed to a high temperature in an oxidizing atmosphere, thereby decreasing adhesion to the multilayered film. Therefore, the effect of the present invention is significantly exhibited when the cemented carbide is used as the substrate.

<Hard film>

As the hard film capable of forming the multilayered film optimum for a cutting tool and exhibiting excellent wear resistance and heat resistance, and of forming the oxide layer useful for forming the alumina film mainly having a α-crystal structure by oxidation, a hard film comprising a compound of the essential metal components Al and Ti with C (carbon), N (nitrogen), B (boron), or O (oxygen) is used.

As the hard film comprising a compound of the essential metal components Al and Ti with C, N, B, or O, a compound of the essential metal components Al and Ti with at least one selected from the group consisting of C, N, B, and O can be used. Preferably, a nitride, a carbide, a carbonitride, a boride, a nitroixde, and a carbonitroxide of Al and Ti are used. Examples of such a compound include TiAlN, TiAlC, TiAlCN, and TiAlNO. In particular, TiAlN is preferred. When a TiAlN film is used as the hard film, the ratio of Ti to Al can be set to any desired value, but the atomic ratio (Ti:Al) is preferably 50:50 to 25:75.

In the present invention, the hard film may comprise a compound containing the essential metal component Al and Ti, at least one component as a third essential component selected from the group consisting of the elements in Group IVa (excluding Ti), Group Va, and Group VIa, and Si, and C, N, B, or O. Thus, the hard film comprises a nitride, a carbide, a carbonitride, a boride, a nitroixde, or a carbonitroxide of these essential components. Examples of such a compound include TiAlCrN, TiAlVN, TiAlSiN, TiAlZrN, TiAlSiCN, and TiAlZrCN. More preferably, the hard film comprises a compound of Al, Ti and Cr with C, N, B, or O (specifically, a nitride, a carbide, a carbonitride, a boride, a nitroixde, or a carbonitroxide of Al, Ti and Cr). Examples of such a compound include TiAlCrN, TiAlCrC, TiAlCrCN, and TiAlCrNO. In this case, the hard film comprising TiAlCrN is more preferred, and the hard film having the composition below is particularly recommended.

The hard film comprises $(Ti_a, Al_b, Cr_c)(C_{1-d}N_d)$ wherein the following relations are satisfied:

$$0.02 \leqq a \leqq 0.30$$

$$0.55 \leqq b \leqq 0.765$$

$$0.06 \leqq c$$

$$a+b+c=1$$

$0.5 \leqq d \leqq 1$ (a, b, c represent the atomic ratios of Ti, Al, and Cr, respectively, and d represents the atomic ratio of N); or $$0.02 \leqq a \leqq 0.175$$

$$0.765 \leqq b$$

$$4(b-0.75) \leqq c$$

$$a+b+c=1$$

$$0.5 \leqq d \leqq 1.$$

In order to sufficiently exhibit the wear resistance and heat resistance expected from the hard film, the thickness of the hard film is preferably 0.5 μm or more, and more preferably 1 μm or more. However, when the hard film is excessively thick, the hard film is easily cracked during cutting to fail to achieve a long lifetime. Therefore, the thickness of the hard film is preferably 20 μm or less, and more preferably 10 μm or less.

Although the method for forming the hard film is not particularly limited, a PVD method is preferred for forming the hard film having a high Al atomic ratio to increase the wear resistance and heat resistance. As the PVD method, an AIP (arc ion plating) method or a reactive sputtering method is preferably used. Also, from the viewpoint of improvement in productivity, the PVD method is preferred for forming the hard film because the hard film and the alumina film mainly having a α-structure can be formed in the same apparatus, as described below.

<Oxide-containing Layer>

In the present invention, after the hard film is formed, the surface of the hard film is oxidized to form the oxide-containing layer. In the oxide-containing layer, the outermost surface substantially comprises alumina, and more preferably α-crystal structure alumina. This is because when the alumina film is formed on the oxide-containing layer, growth of α-crystal structure alumina having excellent wear resistance and heat resistance is easily accelerated to form the α-crystal structure alumina film having excellent adhesion.

The hard film is preferably oxidized under the conditions described below. The oxidation is preferably in an oxidizing gas-containing atmosphere. This is because the oxidation can be efficiently performed. For example, the atmosphere contains an oxidizing gas such as oxygen, ozone, or $H_2O_2$, and of course, an air atmosphere can also be used.

The oxidation is preferably thermal oxidation performed at a substrate temperature kept at 650° C. to 800° C. When the substrate temperature is excessively low, the oxidation cannot be sufficiently performed. The substrate temperature is preferably 700° C. or more. Although the oxidation is promoted by increasing the substrate temperature, the upper limit of the substrate temperature is preferably lower than 1000° C. in consideration of the object of the present invention. In the present invention, the oxide-containing layer useful for forming the alumina film mainly having a α-crystal structure described below can be formed at 800° C. or less.

In the present invention, the other conditions for the oxidation are not particularly limited. Specifically, besides the above-described thermal oxidation, a method of supplying plasma of oxidizing gas such as oxygen, ozone, or $H_2O_2$ is also effective as the oxidation method.

<Alumina Film>

As described above, the multilayered film of the present invention includes the alumina film formed on the oxide-containing layer. As the alumina film, an alumina film mainly having a α-crystal structure (simply referred to as an "alumina film mainly having a α-crystal" hereinafter) having 70% or more of a α-crystal structure is preferred because it exhibits excellent heat resistance. The alumina film more preferably has 90% or more of a α-crystal structure, and most preferably 100% of a α-crystal structure.

The thickness of the alumina film mainly having a α-crystal is preferably 0.1 μm to 20 μm because in order to maintain the excellent heat resistance of the alumina film, it is effective to secure a thickness of 0.1 μm or more. The thickness is more preferably 1 μm or more. However, when the thickness of the alumina film mainly having a α-crystal is excessively large, internal stress occurs in the alumina film to easily produce cracking. Therefore, the thickness is preferably 20 μm or less, more preferably 10 μm or less, and most preferably 5 μm or less.

Examples of a method effective for promoting the formation of the alumina film mainly having a α-crystal include a method (A) in which the surface of the hard film is damaged with alumina powder, the hard film is oxidized to form the oxide-containing layer, and then the alumina film is formed; and a method (B) in which the surface of the hard film is bombarded (etched) by irradiation of Ar ion plasma, the hard film is oxidized to form the oxide-containing layer, and then the alumina film is formed.

Although the method for forming the alumina film on the oxide-containing layer is not particularly limited, a CVD method is undesirable because it must be performed in a high temperature region of 1000° C. or more, and a PVD method capable of deposition in a low temperature region is preferably used. As the PVD method, a sputtering method is preferred, and particularly a reactive sputtering is preferred because high deposition rate can be performed using an inexpensive metal target.

Although the substrate temperature in formation of the alumina film is not particularly limited, the temperature is preferably in the range of about 650° C. to 800° C. because the alumina film mainly having a α-crystal can easily be formed. Subsequently to the oxidation step, the alumina film is preferably formed at substantially the same substrate temperature as that in the oxidation step because the characteristics of the substrate and the hard film can be maintained, and productivity is excellent.

As described above, when oxidation is performed in the oxidizing atmosphere at a substrate temperature of 700° C. or more after the hard film is formed on the substrate, the effect of the present invention is effectively exhibited. For example, the effect of the present invention is effectively exhibited in forming the alumina film, forming another film on the hard film, or performing surface treatment. Particularly, when the surface of the hard film is oxidized at a substrate temperature of 700° C. or more in an oxidizing atmosphere to form the oxide-containing layer, and then the alumina film is formed on the oxide-containing layer at the same substrate temperature, the substrate and the hard film are exposed to a high temperature and the oxidizing atmosphere for a long time to easily diffuse oxygen at the interface between the substrate and the hard film. In this case, the effect of the present invention is effectively exhibited.

Namely, at least one layer which is oxidized at a temperature lower than that of the hard film (for example, oxidization proceeds at a temperature lower than 700° C.) and which is selected from the group consisting of a metal layer, an alloy layer, and a compound layer comprising the metal or alloy and C, N, B, or O is formed as the intermediate layer on the substrate, and then the hard film is formed on the intermediate layer. In this case, even when the oxidation in the oxidizing atmosphere and the formation of the alumina film are continuously performed at a substrate temperature of 700° C. or more, excellent adhesion between the substrate and the multilayered film can be maintained.

In order to form the multilayered film of the present invention, the above-described conditions for producing each of the intermediate layer, the hard film, the oxide-containing layer, and the alumina film are utilized for successively performing the following steps:

(I) the step of forming the intermediate layer on the substrate;

(II) the step of forming the hard film on the intermediate layer;

(III) the step of oxidizing the surface of the hard film to form the oxide-containing layer; and (IV) the step of forming the alumina film on the oxide-containing layer.

When the surface oxidation of the hard film and the formation of the alumina film are successively performed in the same apparatus to produce the multilayered film of the present invention, contamination adhesion to the top of the oxide-containing layer can be avoided to prevent a decrease in adhesion to the alumina film and a hindrance to growth of α-crystal structure alumina. Therefore, the α-crystal structure alumina can easily be formed on the oxide-containing layer to improve productivity.

Preferably, the intermediate layer and the hard film are successively formed in the same apparatus because little contaminations adhere to the surface of the intermediate layer to secure adhesion between the intermediate layer and the hard film and improve productivity.

More preferably, all of the intermediate layer, the hard film, the oxide-containing layer and the alumina film are formed in the same apparatus to prevent impurity contamination between the respective layers, thereby preventing a decrease in adhesion and improving productivity.

For example, a substrate comprising a cemented carbide is placed in a deposition apparatus used in the examples below and comprising an arc evaporation source, magnetron sputtering cathodes, a heater mechanism, and a substrate rotating mechanism. First, the intermediate layer comprising TiN is formed by an AIP method, and then the hard film comprising TiAlN is formed by an AIP method. Then, the surface of the hard film is thermally oxidized in an oxidizing atmosphere of oxygen, ozone, or $H_2O_2$, and then the alumina film mainly having a α-crystal structure is formed by a reactive sputtering method. When the alumina film is formed, the surface of the hard film is preferably bombarded with gas ions and then oxidized because the ratio of the α-crystal in the crystal structure of the alumina film is significantly increased.

Although the present invention will be described in detail below with reference to the examples, the present invention is not limited to these examples, and appropriate changes can be made within the range of the gist of the present invention. These changes are included in the technical field of the present invention. Although, in the examples below, a cemented carbide substrate is used as the substrate, and TiN and TiAlN are used as the intermediate layer and the hard film, respectively, the materials are not limited these materials.

EXAMPLES

A substrate comprising a cemented carbide and having a size of 12.7 mm×12.7 mm×5 mm was mirror-polished (Ra=about 0.02 μm), ultrasonically cleaned in an alkali detergent bath and a pure water bath, and then dried. Then, TiN was deposited on the substrate by an arc ion plating method (AIP method) to form an intermediate layer, and TiAlN was deposited on the intermediate layer to form a hard film and produce a sample (total thickness of the intermediate layer and the hard film of about 2.4 Mm).

As a sample of a comparative example, each of CrN (1.5 μm) and TiAlN (2.5 μm) was deposited on the same substrate as described above by an arc ion plating method to form a hard film.

Figure 1:
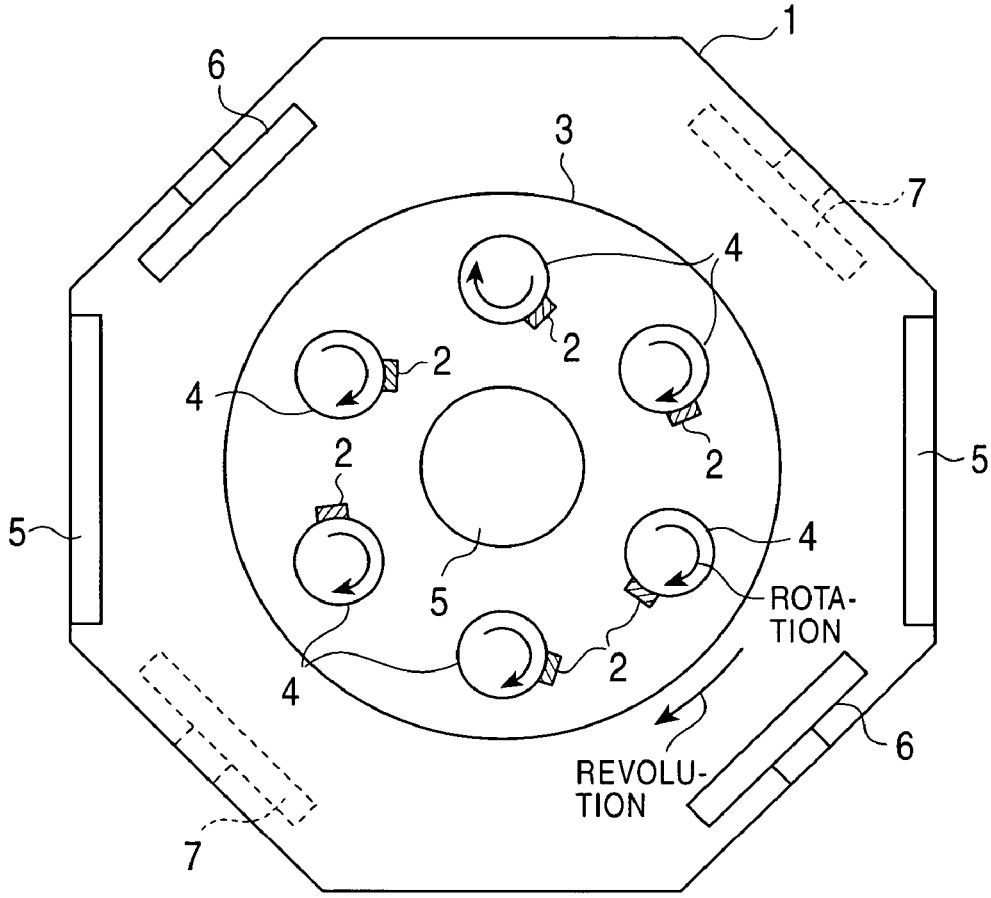
FIG. 1 is a schematic view (top view) illustrating an example of an apparatus used for carrying out the present invention.

In this example, the formation of the intermediate layer, the hard film, and the alumina film, and oxidation of the hard film were performed in a vacuum deposition apparatus (AIP-S40 Hybrid coater produced by Kobe Steel Ltd.) comprising an arc evaporation source, magnetron sputtering cathodes, a heater heating mechanism, and a substrate rotating mechanisms, as shown in FIG. 1.

The hard film was oxidized as follows: These samples (substrates) 2 were set on planetary axes 4 mounted on a rotary table 3 in an apparatus 1, and air in the apparatus 1 was evacuated to a substantially vacuum state. Then, the samples were heated up to 550° C. by heaters 5 disposed at two positions of the side and at the center in the apparatus, and the surface of the samples were cleaned by Ar ion bombardment. Then, the samples were again heated to the temperature shown in Table 1. When the samples reached this temperature, oxygen gas was introduced into the apparatus 1 at a flow rate of 300 sccm until the pressure became 1 Pa, and then the samples were oxidized by heating for 20 minutes.

During the formation of the intermediate layer, the hard film, and the alumina film, and oxidation of the hard film, the rotary table 3 shown in FIG. 1 was rotated (revolved), and the planetary axes 4 (substrate holding pipes) disposed on the rotary table 3 were also rotated (rotated).

Next, the alumina film was formed on the oxide-containing layer. The alumina film was formed in an atmosphere containing argon and oxygen at substantially the same substrate temperature as that in the oxidation, by a pulse DC sputtering method in which an electric power of about 2 kW was applied to each of two sputtering cathodes 6 comprising aluminum targets shown in FIG. 1. The deposition of the alumina film was carried out at the temperature shown in Table 1 for the deposition time shown in Table 1, and sputter discharge was controlled in a so-called transition mode by combining the discharge voltage control and the oxygen flow rate control by plasma emission spectroscopy.

Figure 2:
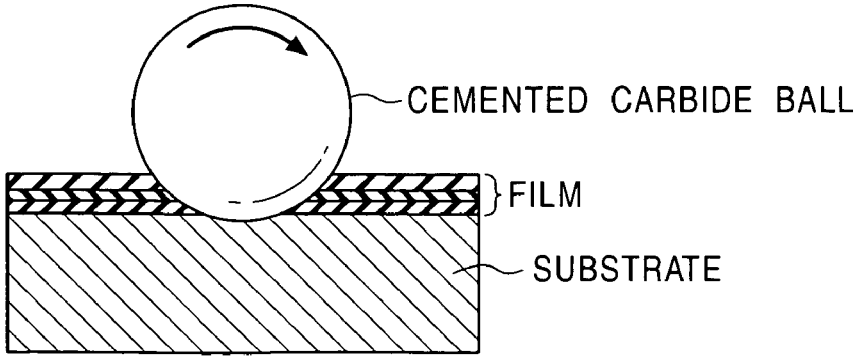
FIG. 2 is a schematic sectional view illustrating a Calotest performed in examples.

The adhesion between the multilayered film and the substrate of each resultant sample was evaluated as follows: A Rockwell C test (HRC test) was performed for the top of the alumina film using a Rockwell hardness tester, and a delamination state of the multilayered film was observed in the periphery of an indentation to evaluate the adhesion. In another method for evaluating the adhesion, as shown in FIG. 2, the multilayered film was abraded (Calotest) by rotating a cemented carbide ball of 30 mm in diameter on the multilayered film until the substrate appeared, and the delamination state of the multilayered film was observed in a circular Calotest indentation after abrading. The deposition conditions and the evaluation results of adhesion are shown in Table 1 and FIGS. 3 to 14.

TABLE 1

| | Intermediate layer | Hard film layer | Substrate temperature (° C.) in oxidation and alumina deposition | Alumina deposition: Deposition time | Alumina deposition: Thickness (μm) | Adhesion: HRC indentation | Adhesion: Calotest indentation |
|---|---|---|---|---|---|---|---|
| Comparative Example 1 | No | CrN 1.5 μm | 700 | 2 hours | 1.68 | A (FIG. 3) | B (FIG. 4) delamination between CrN and substrate |
| Comparative Example 2 | No | TiAlN 2.5 μm | 700 | 2 hours | 1.95 | C (FIG. 5) delamination between TiAlN and substrate | C (FIG. 6) delamination between TiAlN and substrate |
| Example 1 | TiN 0.6 μm | TiAlN 1.8 μm | 700 | 2 hours | 1.95 | A (FIG. 7) | A (FIG. 8) |
| Comparative Example 3 | No | CrN 1.5 μm | 750 | 3 hours | 2.3 | C (FIG. 9) delamination between CrN and substrate | C (FIG. 10) delamination between CrN and substrate |
| Comparative Example 4 | No | TiAlN 2.5 μm | 750 | 2 hours | 1.34 | C (FIG. 11) delamination between TiAlN and substrate | C (FIG. 12) delamination between TiAlN and substrate |
| Example 2 | TiN 0.6 μm | TiAlN 1.8 μm | 750 | 2 hours | 1.34 | A (FIG. 13) | A (FIG. 14) |

A: No delamination B: Delamination C: Significant delamination

A comparison is made of Comparative Examples 1 and 2 and Example 1 in all of which the alumina film was formed at the substrate temperature of 700° C.

Figure 3:
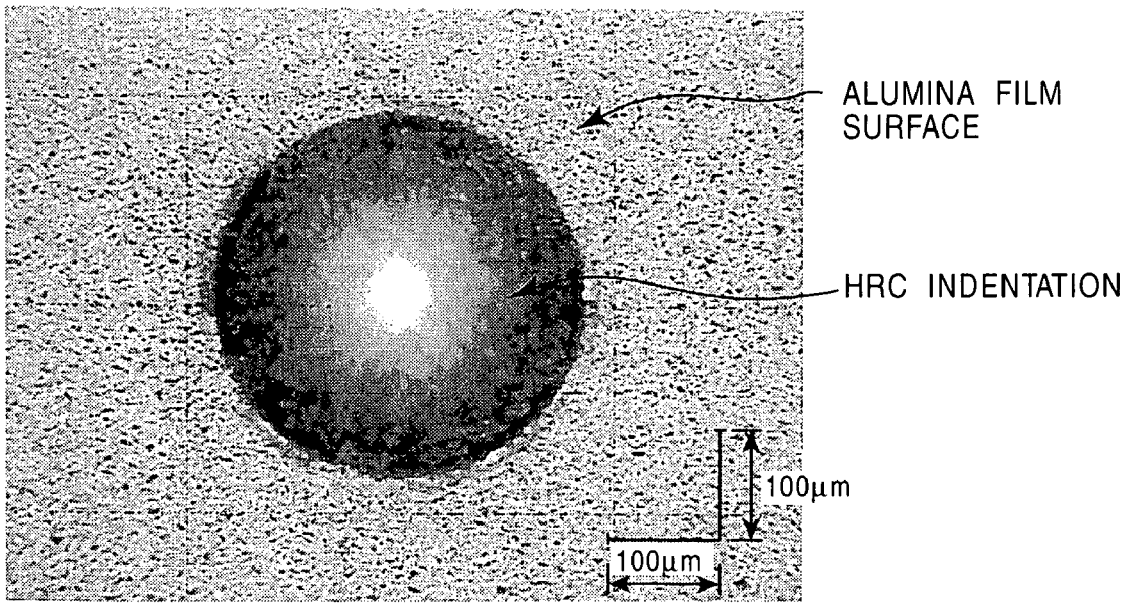
FIG. 3 is a photograph (magnification of ×400) of the top of a HRC indentation in Comparative Example 1.
Figure 4:
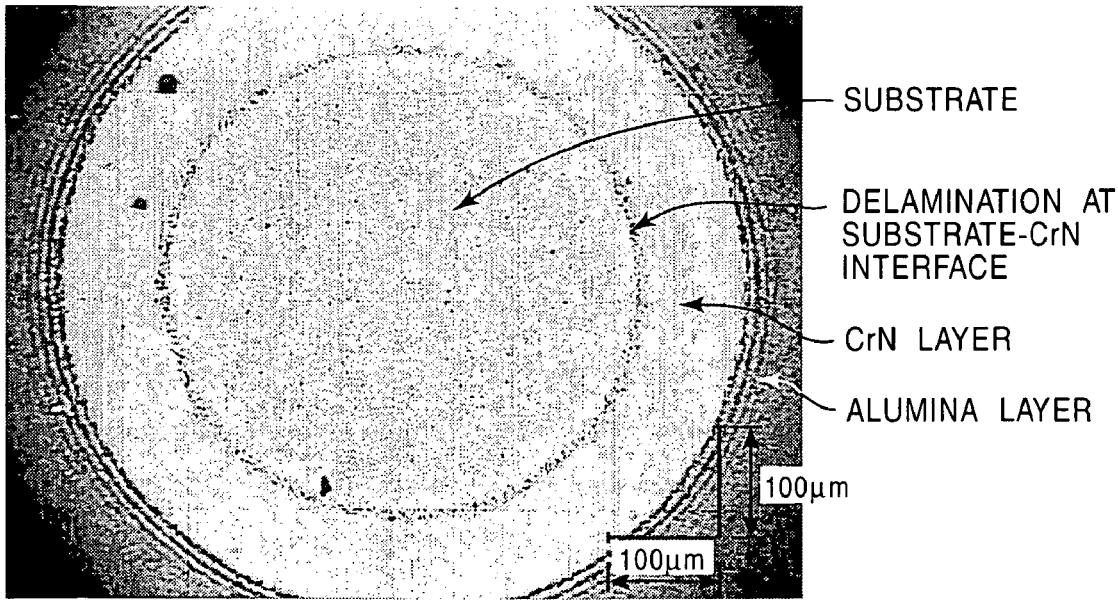
FIG. 4 is a photograph (magnification of ×400) of the top of a Calotest indentation in Comparative Example 1.
Figure 5:
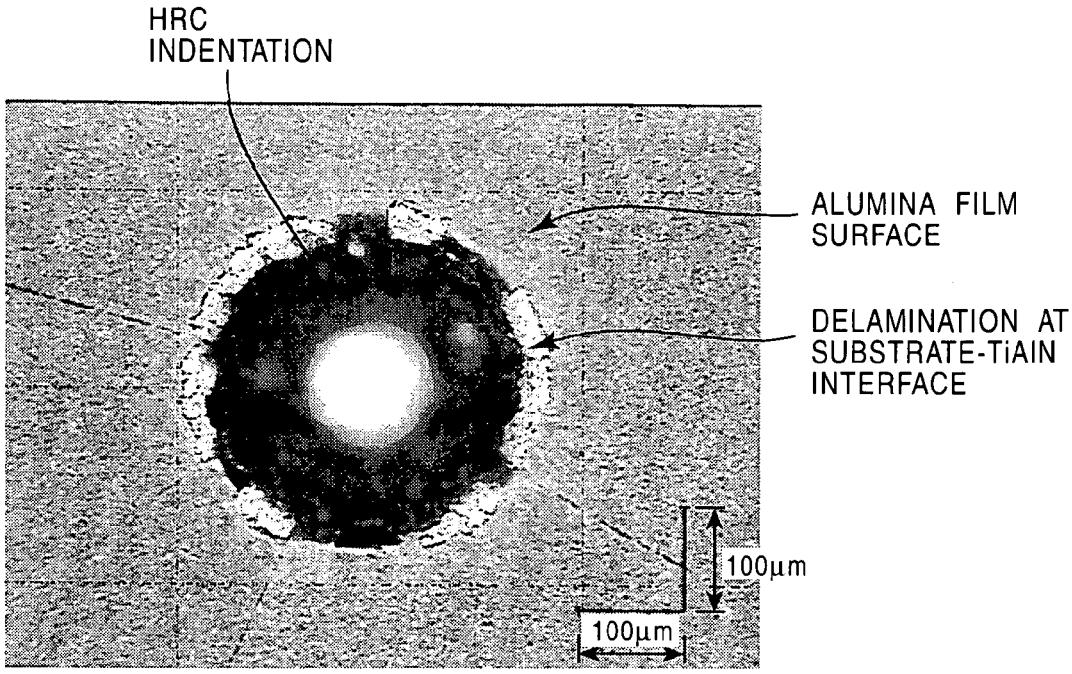
FIG. 5 is a photograph (magnification of ×400) of the top of a HRC indentation in Comparative Example 2.
Figure 6:
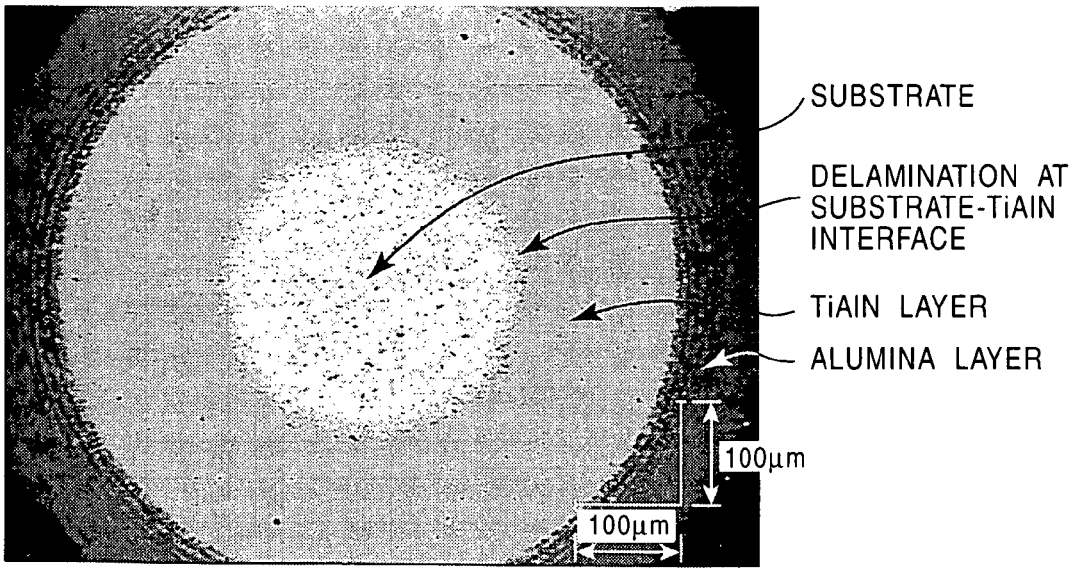
FIG. 6 is a photograph (magnification of ×400) of the top of a Calotest indentation in Comparative Example 2.
Figure 7:
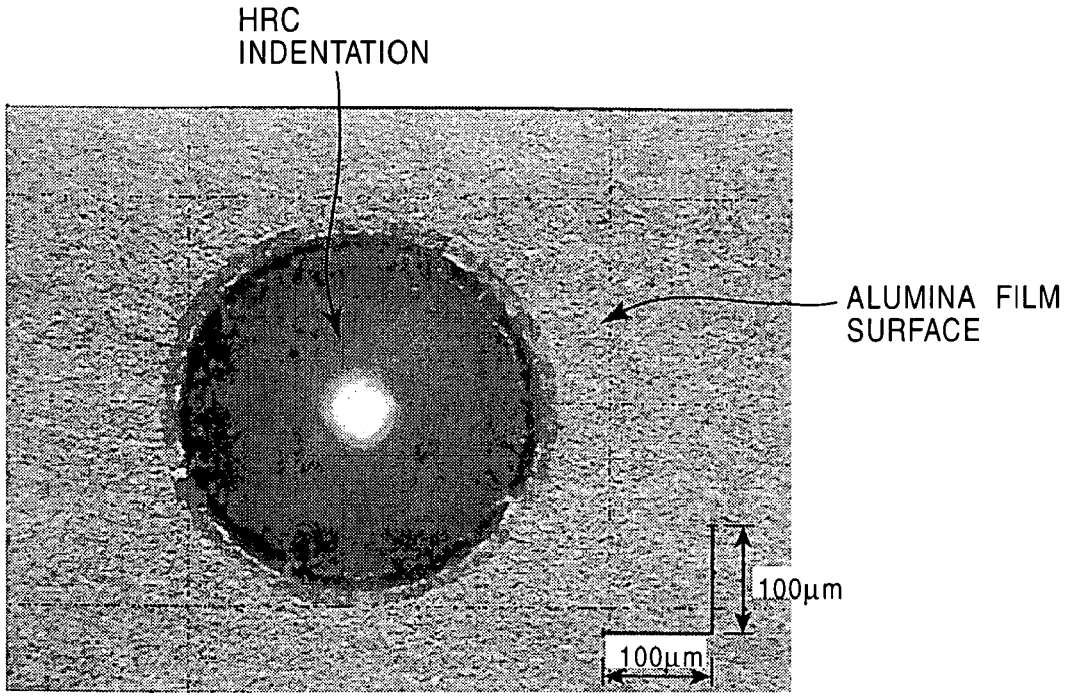
FIG. 7 is a photograph (magnification of ×400) of the top of a HRC indentation in Example 1.
Figure 8:
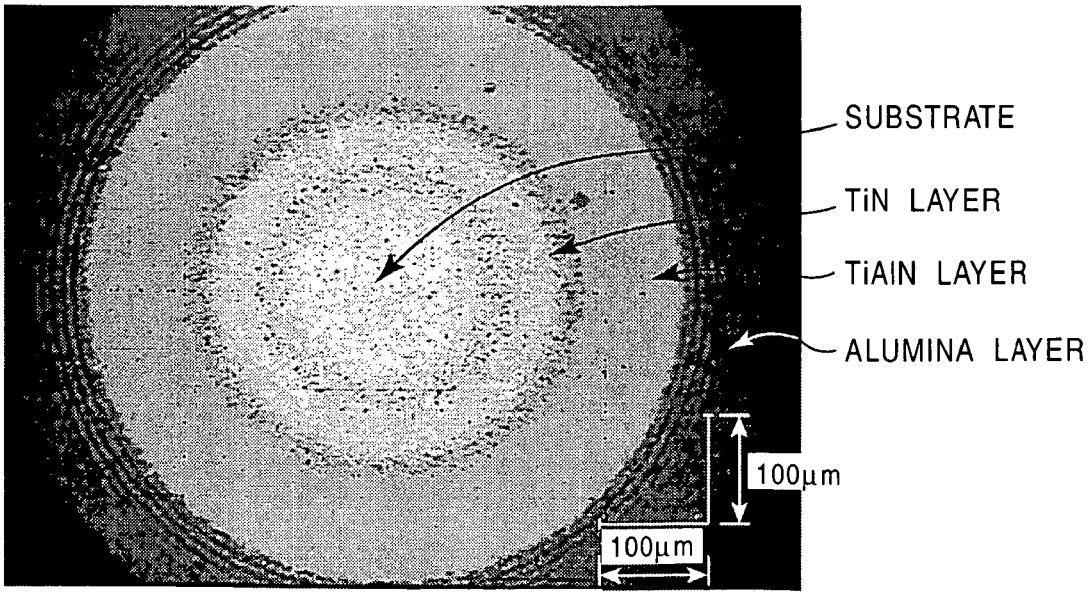
FIG. 8 is a photograph (magnification of ×400) of the top of a Calotest indentation in Example 1.

FIG. 3 shows that in the multilayered film of Comparative Example 1 comprising the hard film (CrN) and the alumina film formed on the substrate, substantially no delamination was observed in the HRC indentation in the Rockwell hardness test. However, delamination of the CrN layer was observed in the Calotest indentation (FIG. 4). In the multilayered film of Comparative Example 2 comprising the hard film (TiAlN) and the alumina film formed on the substrate, delamination of TiAlN from the substrate was observed in the HRC indentation shown in FIG. 5, and similarly, delamination of the TiAlN layer from the substrate was observed in the Calotest indentation (FIG. 6). On the other hand, in the multilayered film of Example 1 comprising the intermediate layer (TiN), the hard film (TiAlN), and the alumina film which were laminated in order on the substrate, no delamination of the multilayered film was observed in both the HRC indentation shown in FIG. 7 and the Calotest indentation shown in FIG. 8.

A comparison is made of Comparative Examples 3 and 4 and Example 2 in all of which the alumina film was formed at the substrate temperature of 750° C.

As described above, in Comparative Example 1 in which the alumina film was formed at the substrate temperature of 700° C., substantially no delamination was observed in the periphery of the HRC indentation of the multilayered film comprising the CrN film and the alumina film. However, in Comparative Example 3 shown in Table 1 in which the alumina film was formed at the substrate temperature of 750° C., delamination was observed over the whole periphery of the HRC indentation shown in FIG. 9. Also, it was confirmed from FIG. 10 that delamination of CrN from the substrate significantly occurred in the Calotest indentation.

Figure 11:
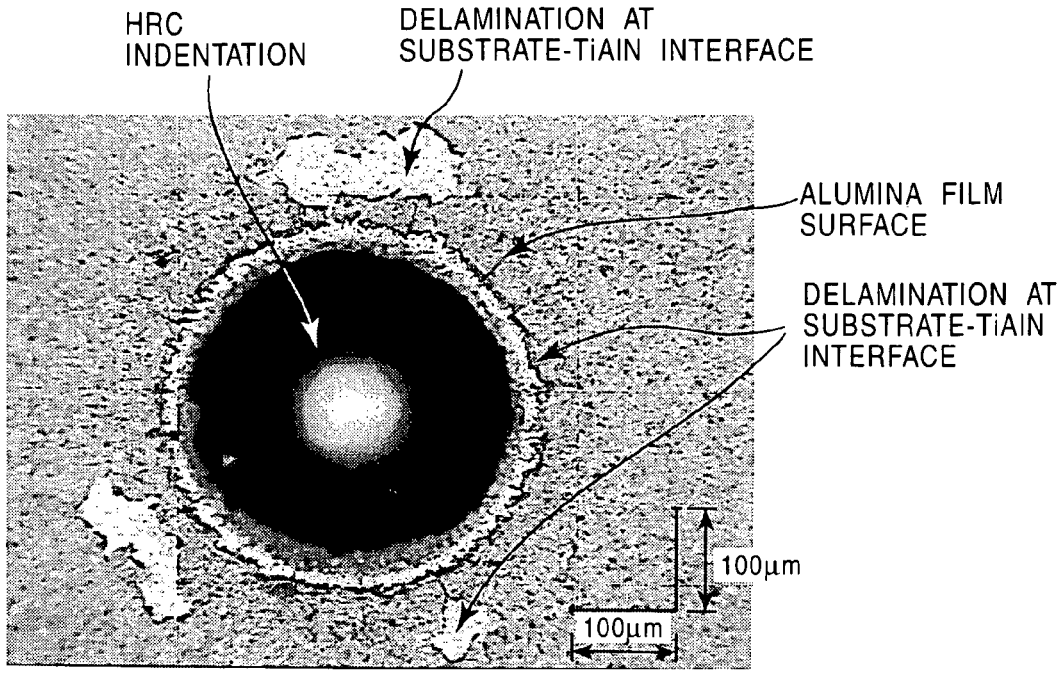
FIG. 11 is a photograph (magnification of ×400) of the top of a HRC indentation in Comparative Example 4.
Figure 12:
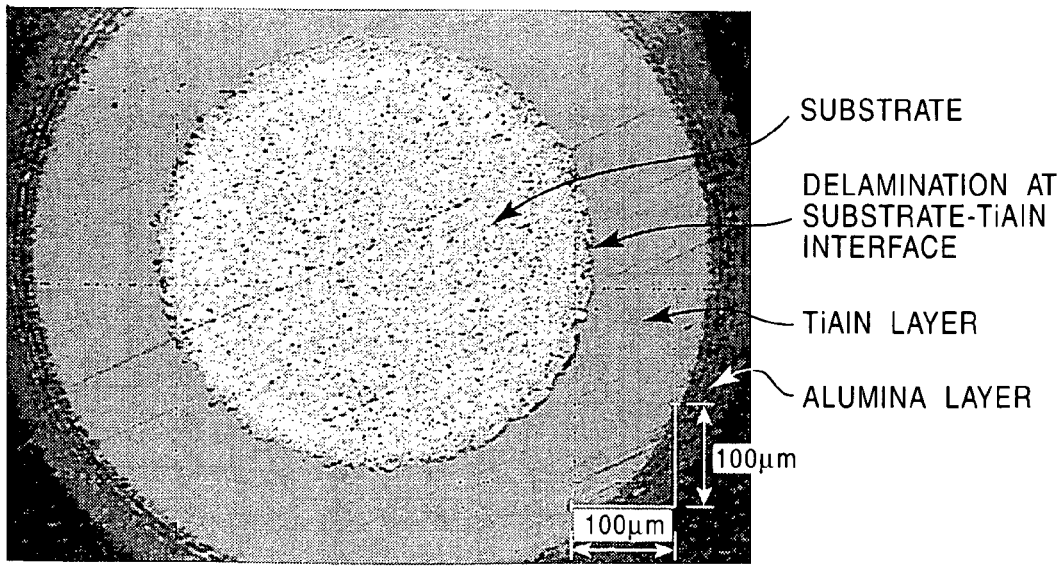
FIG. 12 is a photograph (magnification of ×400) of the top of a Calotest indentation in Comparative Example 4.

When the hard film (TiAlN) and the alumina film were formed on the substrate, delamination of the multilayered film significantly occurred in the example in which the alumina film was formed at 750° C., as compared with the example (Comparative Example 2) in which the alumina film was formed at 700° C. FIG. 11 is a photograph showing a HRC indentation of the multilayered film comprising the hard film (TiAlN) and the alumina film formed on the substrate, the alumina film being formed at the substrate temperature of 750° C. (Comparative Example 4), and FIG. 12 is a photograph showing a Calotest indentation of the same multilayered film. The two photographs show that delamination of TiAlN significantly occurs in comparison with Comparative Example 2 (FIGS. 5 and 6).

Figure 13:
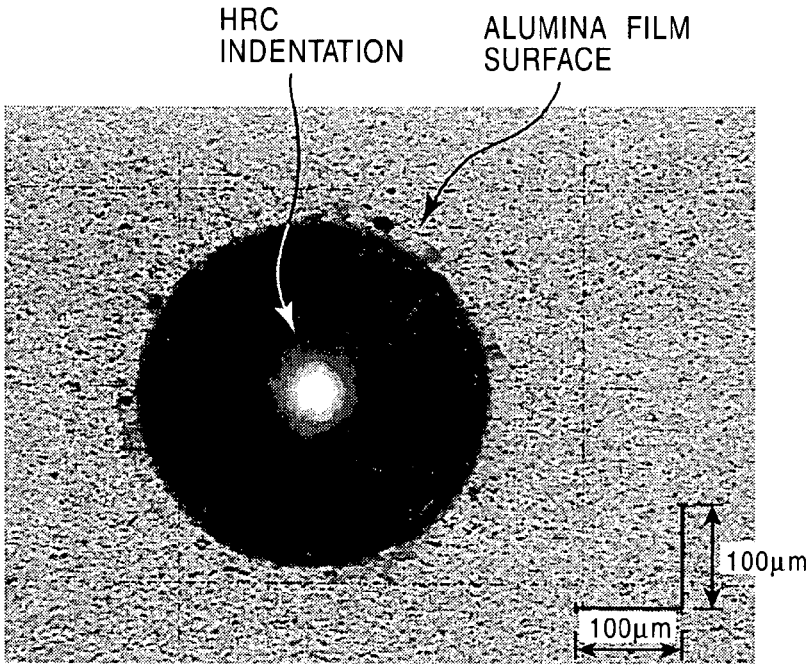
FIG. 13 is a photograph (magnification of ×400) of the top of a HRC indentation in Example 2.
Figure 14:
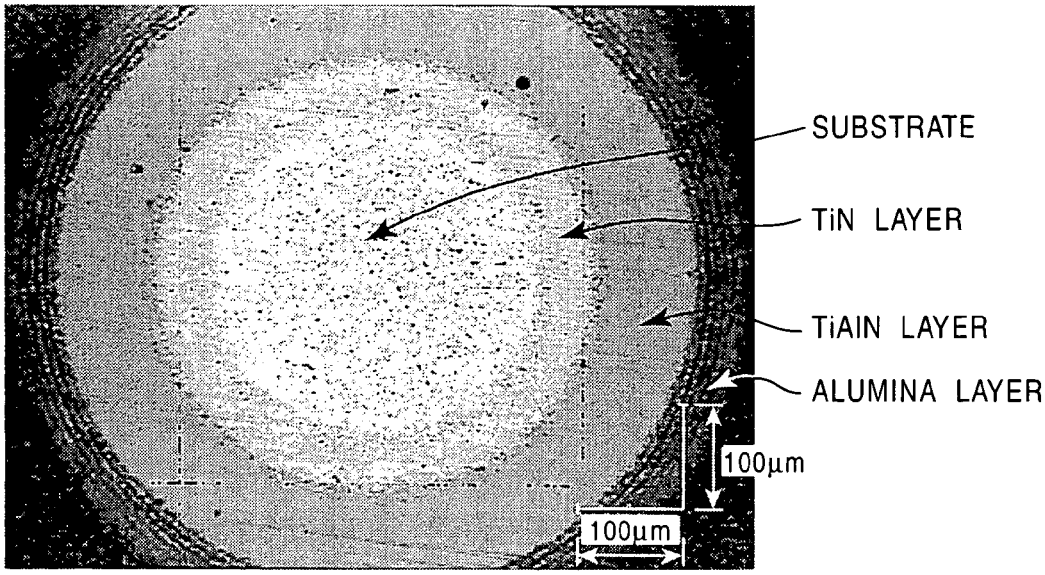
FIG. 14 is a photograph (magnification of ×400) of the top of a Calotest indentation in Example 2.

On the other hand, in the multilayered film (TiN+TiAlN+alumina film) of Example 2 comprising the intermediate layer (TiN) provided between the substrate and the hard film, even when the alumina film was formed at the substrate temperature of 750° C., substantially no delamination of the multilayered film was observed in both the HRC indentation shown in FIG. 13 and the Calotest indentation shown in FIG. 14, like in the case in which the alumina film was formed at the substrate temperature of 700° C.

The invention claimed is:

1. A multilayered film provided on a substrate and having excellent wear resistance, excellent heat resistance, and excellent adhesion to the substrate, the multilayered film comprising:

a hard film comprising a compound of metal components essentially including Al and Ti;

an intermediate layer formed between the substrate and the hard film, the intermediate layer comprising at least one selected from the group consisting of a metal, an alloy, and a compound of the metal or the alloy, and having an oxidation temperature lower than that of the hard film;

an oxide-containing layer formed by oxidizing the hard film so that the oxide-containing layer is disposed on the surface of the hard film remote from the intermediate layer; and an alumina film formed on the surface of the oxide-containing layer remote from the hard film.

2. The multilayered film according to claim 1, wherein the compound of the hard film is a compound of the metal components with at least one element selected from the group consisting of C, N, B, and O.

3. The multilayered film according to claim 1, wherein the hard film further comprises at least one metal component selected from the group consisting of Groups IVa (excluding Ti), Va, and VIa elements, and Si.

4. The multilayered film according to claim 1, wherein the thickness of the hard film is 0.5 μm to 20 μm.

5. The multilayered film according to claim 1, wherein the intermediate layer can be oxidized at a temperature lower than 700° C.

6. The multilayered film according to claim 1, wherein the intermediate layer comprises Ti or a Ti alloy.

7. The multilayered film according to claim 1, wherein the intermediate layer comprises a compound of Ti with at least one element selected from the group consisting of C, N, B, and O.

8. The multilayered film according to claim 1, wherein the thickness of the intermediate layer is 0.1 μm to 20 μm.

9. The multilayered film according to claim 1, wherein the outermost surface of the oxide-containing layer substantially comprises alumina.

10. The multilayered film according to claim 1, wherein the alumina film mainly has a α-crystal structure.

11. The multilayered film according to claim 1, wherein the thickness of the alumina film is 0.1 μm to 20 μm.

12. A method for producing a multilayered film provided on a substrate and having excellent wear resistance, excellent heat resistance, and excellent adhesion to the substrate, the method comprising the steps of:

forming an intermediate layer on a surface of the substrate;

forming a hard film on the intermediate layer;

oxidizing a surface of the hard film to form an oxide-containing layer;

forming an alumina film on the oxide-containing layer; and producing the multilayered film of claim 1, wherein in at least one of the step of oxidizing the surface of the hard film to form the oxide-containing layer and the step of forming the alumina film on the oxide-containing layer, the substrate is exposed to a temperature of 700° C. or more in an oxidizing atmosphere.

13. The method according to claim 12, wherein the step of oxidizing the surface of the hard film to form the oxide-containing layer and the step of forming the alumina film are successively performed in the same apparatus.

14. The method according to claim 12, wherein the step of forming the intermediate layer on the substrate and the step of forming the hard film on the intermediate layer are successively performed in the same apparatus.

15. The method according to claim 12, wherein the step of forming the intermediate layer on the substrate, the step of forming the hard film on the intermediate layer, the step of oxidizing the surface of the hard film to form the oxide-containing layer, and the step of forming the alumina film are successively performed in the same apparatus.

* * * * *